US006199367B1

(12) United States Patent
Howell

(10) Patent No.: US 6,199,367 B1
(45) Date of Patent: Mar. 13, 2001

(54) AIR MODULATED CARBURETOR WITH AXIALLY MOVEABLE FUEL INJECTOR TIP AND SWIRLER ASSEMBLY RESPONSIVE TO FUEL PRESSURE

(75) Inventor: Stephen J. Howell, Georgetown, MA (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 08/638,044

(22) Filed: Apr. 26, 1996

(51) Int. Cl.[7] ..... F02C 9/00; F23R 3/14

(52) U.S. Cl. ..... 60/39.23; 60/39.27; 60/748; 239/402.5; 239/416.4; 239/406; 431/89; 431/186

(58) Field of Search ..... 60/39.23, 39.27, 60/39.48, 734, 737, 741, 748, 740, 39.32, 240; 239/416, 416.4, 405, 406, 402.5, 420; 431/9, 12, 89, 90, 186

(56) References Cited

U.S. PATENT DOCUMENTS

| | | | | |
|---|---|---|---|---|
| H19 | * | 2/1986 | Carlson | 239/406 |
| 1,679,830 | * | 8/1928 | Lang | 431/186 |
| 1,786,946 | * | 12/1930 | Hofmann | 60/741 |
| 2,090,566 | * | 8/1937 | Andler | 239/406 |
| 2,216,508 | * | 10/1940 | Zink | 239/402.5 |
| 2,242,787 | * | 5/1941 | Lieberherr | 431/186 |
| 2,303,925 | * | 12/1942 | Fisher | 431/186 |
| 2,538,460 | * | 1/1951 | Kaveny | 239/402.5 |
| 2,655,787 | * | 10/1953 | Brown | 60/39.23 |
| 2,837,894 | * | 6/1958 | Kind | 60/39.27 |
| 2,884,758 | * | 5/1959 | Oberle | 60/748 |
| 3,032,097 | * | 5/1962 | Marshall | 431/9 |
| 3,095,153 | * | 6/1963 | Soth | 60/741 |
| 3,728,859 | * | 4/1973 | Seiler | 60/39.23 |
| 3,741,166 | * | 6/1973 | Bailey | 431/9 |
| 3,788,797 | * | 1/1974 | Mayfield et al. | 431/186 |
| 3,864,073 | * | 2/1975 | Kolhi | 431/9 |
| 3,886,728 | * | 6/1975 | Quinn | 60/39.23 |
| 4,050,879 | * | 9/1977 | Takahashi et al. | 431/186 |
| 4,160,640 | * | 7/1979 | Maev et al. | 431/9 |
| 4,199,934 | * | 4/1980 | Meyer | 60/39.23 |
| 4,202,170 | * | 5/1980 | Meyer | 60/39.23 |
| 4,216,908 | * | 8/1980 | Sakurai et al. | 239/406 |
| 4,454,711 | * | 6/1984 | Ben-Porat | 60/39.32 |
| 4,479,442 | * | 10/1984 | Itse et al. | 431/186 |
| 5,257,499 | * | 11/1993 | Leonard | 60/39.23 |
| 5,333,459 | * | 8/1994 | Berger | 60/748 |
| 5,373,693 | * | 12/1994 | Zarzalis et al. | 60/39.23 |
| 5,605,287 | * | 2/1997 | Mains | 60/736 |
| 5,664,412 | * | 9/1997 | Overton | 60/748 |
| 5,673,552 | * | 10/1997 | Idleman et al. | 60/39.23 |

FOREIGN PATENT DOCUMENTS

| | | | | |
|---|---|---|---|---|
| 2407483 | * | 8/1975 | (DE) | 60/39.32 |
| 867727 | * | 5/1961 | (GB) | 239/402.5 |

* cited by examiner

*Primary Examiner*—Ted Kim
(74) *Attorney, Agent, or Firm*—Andrew C. Hess; Rodney M. Young

(57) ABSTRACT

A gas turbine engine carburetor includes a fuel injector and a cooperating air swirler for injecting fuel and air into a combustor. The fuel injector includes a hollow body joined to a supporting stem for receiving fuel therein for flow through an injector tip slidingly mounted to the injector body for movement relative thereto. The air swirler surrounds the injector tip and is spaced form the injector body to define an air inlet, and is spaced from the injector tip to define an air outlet. A spring operatively engages the injector body and the injector tip and is preloaded for biasing the injector tip to an initial position. The spring is sized so that increasing pressure of the fuel in the injector body further loads the spring for moving the injector tip from the initial position to a displaced position, with movement of the injector tip modulating airflow through the swirler for in-turn modulating the ratio of discharged fuel and air.

19 Claims, 2 Drawing Sheets

AIR MODULATED CARBURETOR WITH AXIALLY MOVEABLE FUEL INJECTOR TIP AND SWIRLER ASSEMBLY RESPONSIVE TO FUEL PRESSURE

BACKGROUND OF THE INVENTION

The present invention relates generally to gas turbine engines, and, more specifically, to combustors having low exhaust emissions.

In a gas turbine engine, air is compressed in a compressor, mixed with fuel and ignited for generating combustion gases in a combustor, with the gases flowing downstream through one or more turbine stages which extract energy therefrom for powering the compressor and providing useful work. Aircraft gas turbine engines include various configurations having propellers or fans driven by a core engine. The size of the engine, and correspondingly its output power, varies from relatively small turboprop engines to relatively large turbofan engines.

For large commercial turbofan aircraft engines, a significant amount of fuel is burned for propelling the aircraft in flight, and limiting undesirable exhaust emissions therefrom is a significant design factor. At high power operation, low levels of NOx and smoke are desired, with NOx emissions increasing with combustion gas temperature and residence time in the combustor. At engine idle, low CO and hydrocarbon emissions are desired, with longer combustor residence times being desired for reducing these emissions.

In order to accommodate these different requirements for reducing exhaust emissions over the useful operating range of a gas turbine engine, combustion staging is typically provided and includes specifically configured burning zones for reducing exhaust emissions. In one example referred to as a double dome combustor, the combustor is configured with two concentric dome rings spaced radially apart by an annular centerbody, with each of the domes having a plurality of circumferentially spaced apart carburetors mounted therein.

Each carburetor includes a fuel injector discharging fuel into a corresponding air swirler for providing a fuel and air mixture downstream of the respective domes. The air swirlers are stationary, fixed geometry components through which respective portions of compressed air are swirled and mixed with fuel injected from the injectors. Each injector may take any suitable form, with a conventional fuel supply providing fuel thereto at varying flowrates and pressure for varying the output power of the combustor and thereby the output power of the engine.

Fuel staging may be accomplished using the fuel injectors themselves, and fuel staging may also be effected by selectively operating different ones of the several fuel injectors. For example, one of the domes may define a pilot combustion zone, with the other dome defining a main combustion zone, with the fuel injectors for the main zone being off at low power operation of the engine. At high power operation of the engine both the pilot and main zones are supplied with fuel. This combustor configuration allows the fuel/air ratio and distribution to be modulated for reducing the different exhaust emissions from low to high power operation of the engine.

Another conventional embodiment includes a triple dome combustor, which is an extension of the double dome combustor, for yet further reducing the different exhaust emissions over the operating range of the engine. Multi-dome combustors are correspondingly more complex to construct and operate and are typically found in only very large gas turbine engines. The components of a multi-dome combustor are not readily scalable in size for use in relatively small gas turbine engines.

Accordingly, the ability to further modulate fuel and air distribution in a gas turbine combustor for reducing exhaust emissions is desirable. Also desired is the ability to further modulate fuel/air distribution in small combustors, in addition to large combustors.

SUMMARY OF THE INVENTION

A gas turbine engine carburetor includes a fuel injector and a cooperating air swirler for injecting fuel and air into a combustor. The fuel injector includes a hollow body joined to a supporting stem for receiving fuel therein for flow through an injector tip slidingly mounted to the injector body for movement relative thereto. The air swirler surrounds the injector tip and is spaced form the injector body to define an air inlet, and is spaced from the injector tip to define an air outlet. A spring operatively engages the injector body and the injector tip and is preloaded for biasing the injector tip to an initial position. The spring is sized so that increasing pressure of the fuel in the injector body further loads the spring for moving the injector tip from the initial position to a displaced position, with movement of the injector tip modulating airflow through the swirler for in-turn modulating the ratio of discharged fuel and air.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
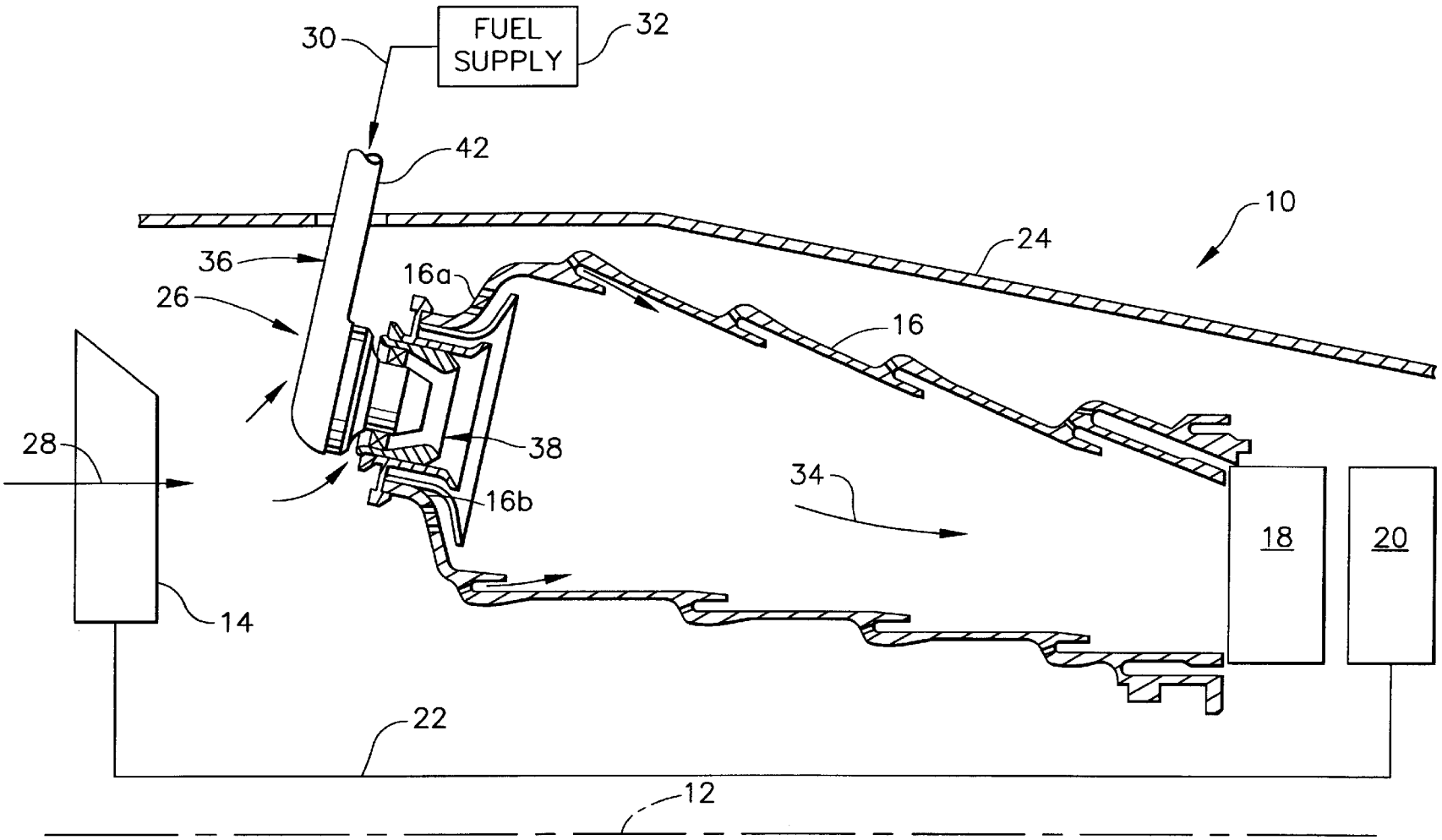
FIG. 1 is a schematic, partly sectional axial view of a portion of an exemplary aircraft gas turbine engine including a compressor, combustor, turbine, and carburetors in accordance with an exemplary embodiment of the present invention.

Illustrated schematically in FIG. 1 is a portion of an aircraft gas turbine engine 10 having in serial flow communication and coaxially disposed about a longitudinal, axial centerline axis 12 a compressor 14, combustor 16, high pressure turbine nozzle 18, and high pressure turbine 20 joined to the compressor 14 by a core engine rotor shaft 22. These components may take any conventional form and are disposed coaxially within an annular casing 24.

In the exemplary embodiment illustrated in FIG. 1, the combustor 16 includes concentric, annular outer and inner combustion liners joined together at a single annular dome 16*a* at the upstream ends thereof, which dome includes a plurality of circumferentially spaced apart access holes 16*b*. Each of the access holes 16*b* includes a carburetor 26 for mixing fuel and air in accordance with an exemplary embodiment of the present invention.

During operation, air 28 is compressed in the compressor 14 and is channeled through the carburetors 26 wherein it is mixed with fuel 30 supplied by conventional means in the form of a fuel supply 32 including suitable conduits, valves, and pumps for delivering the fuel 30 to the carburetor 26 under varying pressure. The air and fuel are mixed by the carburetors 26 and discharged into the combustor 16 wherein the mixture is conventionally ignited for generating combustion gases 34 which are discharged from the combustor and flow through the nozzle 18 and turbine 20. The turbine 20 extracts energy from the combustion gases for powering the compressor 14, and a power turbine (not shown) is also provided for extracting additional power for powering a fan (not shown), for example, in propelling an aircraft in flight.

The carburetors 26 are configured in accordance with the present invention for modulating airflow therethrough so that the fuel/air ratio of the mixture discharged from the carburetors 26 may be modulated for reducing exhaust emissions produced in the combustion gases 34 in various modes of operation from low power in an idling engine to high power at aircraft takeoff thrust levels. At idle power, it is desired to reduce carbon monoxide (CO) and unburned hydrocarbons which may be obtained by increasing the bulk gas residence time and combustion temperature within the combustor 16 for obtaining more complete combustion. At high power, it is desired to reduce nitrous oxide (NOx) and smoke emissions which may be obtained by operating the combustor with a lean fuel-to-air ratio and with a relatively low bulk gas residence time.

Figure 2:
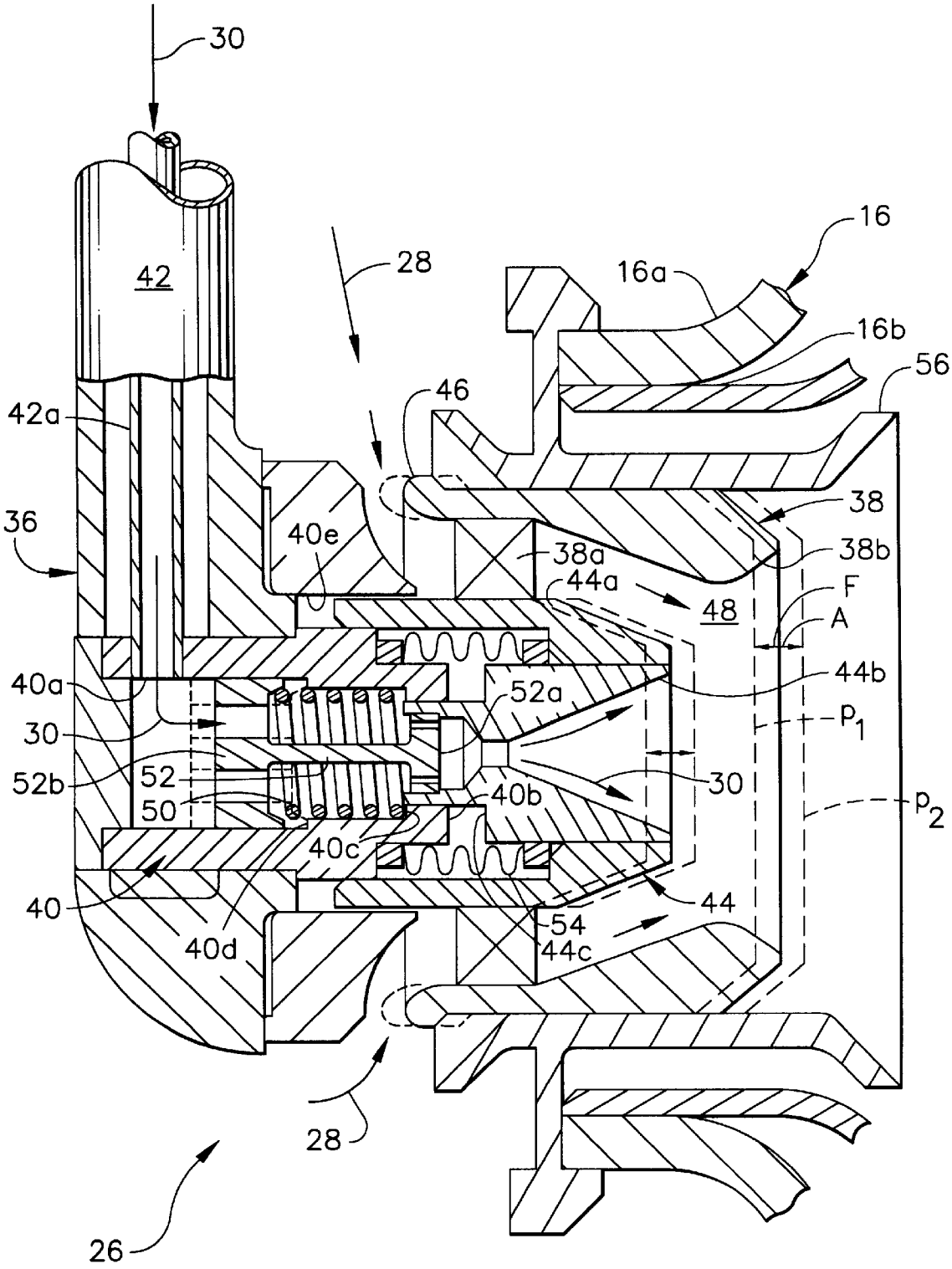
FIG. 2 is an enlarged, partly sectional axial view of one of the carburetors joined to the combustor illustrated in FIG. 1 in accordance with an exemplary embodiment of the present invention.

The carburetor 26 is illustrated in more particularity in FIG. 2 in accordance with an exemplary embodiment of the present invention which effects hydraulically driven variable geometry airflow through the carburetor 26 for modulating the flowrate of the compressed air 28 passing through the carburetors 26 and into the combustor 16. Air modulation may therefore be used for modulating the fuel/air ratio and combustion temperature, as well as modulating the bulk residence time within the combustor 16.

Each of the carburetors 26 includes a fuel injector 36 for discharging the fuel 30 into the combustor 16, with a cooperating annular air swirler 38 which channel a respective portion of the compressed air 28 around the injected fuel for providing an atomized fuel and air mixture which undergoes combustion in the combustor 16. The fuel injector 36 includes a stationary hollow body 40 suitably fixedly joined to a distal end of a hollow supporting stem 42 for receiving the fuel 30 therein. The stem 42 may take any conventional form and extends radially outwardly through the casing 24 as illustrated in FIG. 1 and is suitably fixedly joined thereto. The stem preferably includes an inner conduit 42*a* shown in FIG. 2 which is conventionally air insulated within the stem 42, with the conduit 42*a* being joined in flow communication with the fuel supply 32 illustrated in FIG. 1 which regulates flowrate and pressure of the fuel delivered to each fuel injector 36 in a conventional manner.

As shown in FIG. 2, each fuel injector 36 further includes an injector tip 44 slidingly mounted to the injector body 40 for selective movement relative thereto. The injector tip 44 is disposed in flow communication with the injector body 40 for receiving the fuel and discharging the fuel into the combustor 16.

The air swirler 38 surrounds the injector tip 44, and is spaced in part from the injector body 40 at its forward end to define an annular inlet 46 for receiving the compressed air 28 from the compressor 14. An aft end of the swirler 38 is spaced radially outwardly from an aft end of the injector tip 44 to define an annular outlet 48 for discharging swirled air from the swirler 38 concentrically around the fuel discharged from the injector tip 44.

Means in the exemplary form of a compression spring 50 operatively engages the injector body 40 and the injector tip 44, and is suitably preloaded in compression for biasing the injector tip 44 to an initial, axially forward position designated $P_1$. The spring 50 is suitably sized in spring rate so that increasing pressure of the fuel 30 in the injector body 40 further loads and compresses the spring 50 for moving the injector tip 44 from the initial position $P_1$ to a displaced tip position $P_2$, with movement of the injector tip 44 varying or modulating airflow through the swirler 38 for in-turn modulating the ratio of the injector tip discharged fuel to the swirler outlet air. Modulation of the flowrate and pressure of the fuel is well known and may be accomplished using any suitable conventional means in the fuel supply 32, as well as in various forms of the fuel injector 36.

By slidingly mounting the injector tip 44 in accordance with the present invention, modulation also of the compressed air 28 channeled through the swirler 38 may now be obtained for providing additional modulation of the resulting fuel/air ratio of the mixture discharged from each carburetor 26. The additional ability for modulating the swirler airflow may be used to advantage in further decreasing undesirable exhaust emissions from the combustor 16 during operation in relatively small as well as large combustor designs. Fuel injectors and air swirlers are conventionally known and take various configurations for use in gas turbine engines. Conventional fuel injectors and air swirlers may be suitably modified in accordance with the present invention for using the pressurized fuel which is channeled through the fuel injector to hydraulically drive the injector tip 44 and air swirler 38 attached thereto for effecting variable geometry and airflow modulation.

In the exemplary embodiment illustrated in FIG. 2, the fuel injector 36 further includes an internal spool 52 disposed inside the injector body 40. The spool 52 includes an annular spin disk 52*a* integrally formed to the aft or downstream end thereof, with the spin disk 52*a* taking any conventional form to include circumferentially angled metering holes which spin the fuel, and are sized for metering the fuel into the injector tip 44 and developing a pressure drop thereacross. Fixedly joined to an opposite or forward end of the spool 52 is an orifice disk 52*b* with relatively large axial through holes for channeling the fuel 30 to the spin disk 52*a* without substantial flow resistance. The spool 52 may be a one-piece cast assembly sized for sliding axially within the injector body 40. Fuel flows axially through the orifice disk 52*b* inside the injector body 40 and through the spin disk 52*a* which swirls the fuel in the downstream direction.

In the exemplary embodiment illustrated in FIG. 2, the spin disk 52*a* is suitably fixedly joined to the injector tip 44 by an interference fit or brazing for example, and is effective for swirling the fuel therein. The spring 50 is disposed between the aft side of the orifice disk 52*b* and a corresponding portion of the injector body 40 so that increasing pressure drop developed across the spin disk 52*a* moves the spool 52 and in-turn the injector tip 44 joined thereto for modulating the swirler airflow.

In the preferred embodiment, the fuel 30 is provided to the injector body 40 at a relatively low pressure for idle operation and at relatively high pressure for high power operation for effecting primarily two-step spool positioning. Correspondingly, the injector tip 44, and swirler 38 attached thereto, operate at two preferred positions including the initial position $P_1$ shown in phantom to the left, or in the forward (F) direction from the center position illustrated, and in the fully displaced position $P_2$ shown in phantom line to the right of the center position. With little or no fuel pressure, the injector tip 44 remains at its initial position $P_1$ due to the preloading of the spring 50. As the fuel pressure is increased and exceeds a preselected value, the pressure drop across the spin disk 52*a* causes the spring 50 to be further compressed which axially moves the spool 52 and injector tip 44 attached thereto in the aft (A) direction.

The fuel pressure in the fuel injector 36 may be used for modulating airflow in various manners including the axially aft translation (A) of the injector tip 44 illustrated; or in an alternate embodiment with axially forward (F) translation (not shown); or yet in another alternate embodiment (not shown) by circumferential rotation of the injector tip 44.

In the exemplary embodiment illustrated in FIG. 2, the injector body 40 includes an inlet 40*a* for receiving the fuel from the stem 42, an outlet 40*b* which slidingly receives a forward end of the injector tip 44, and an annular internal aft step 40*c* disposed adjacent to the body outlet 40*b* for supporting the aft end of the spring 50 in abutting contact. The opposite or forward end of the spring 50 engages a suitable counterbore in the aft end of the orifice disk 52*b*. The spring 50 may therefore be initially preloaded in compression between the orifice disk 52*b* and the body aft step 40*c* for axially translating the spool 52 to its corresponding initial position (shown in phantom) forwardly from the body outlet 40*b*. With suitably low fuel pressure, the spring 50 translates the spool 52 in the forward (F) direction, and as pressure of the fuel increases in the injector body 40, the increasing pressure drop across the spin disk 52*a* translates the spool 52 axially aft (A) to further compress the spring 50 and axially translate the injector tip 44 to its displaced position.

In order to limit the axial travel of the spool 52, the injector body 40 further includes an annular, internal forward step 40d spaced axially forwardly of the aft step 40*c* which is sized for receiving the perimeter of the orifice disk 52*b*. The spool 52 is suitably sized in axial length to initially position the orifice disk 52*b* away from the forward step 40*d*, with the forward step 40*d* providing a stop for limiting aft travel of the orifice disk 52*b* and the injector tip 44 upon further compression of the spring 50.

The injector tip 44 preferably includes a radially outer shroud 44*a*, and a radially inner hub 44*b* radially spaced in part at its forward end from the tip shroud 44*a*. The tip hub 44*b* includes a cylindrical forward end having an outer surface slidingly engaging the body outlet 40*b*, and fixedly receives the spin disk 52*a* therein. The spin disk 52*a* may be joined to the injector tip 44 in an interference fit at this location or by being suitably brazed thereto. Disposed downstream of the spin disk 52*a* in the injector tip hub 44*b* in serial flow communication are a conventional spin chamber for receiving the swirled fuel from the spin disk 52*a*, a throat or venturi, and a diverging spray cone which take any conventional configuration for discharging the swirled fuel into the combustor 16. The spool 52 and the injector tip 44 are therefore joined together in an integral component which moves axially in response to spring force and the varying fuel pressure.

The tip hub 44*b* preferably also includes an external forward step 44*c* around its forward end which axially abuts the distal end of the body outlet 40*b* (shown in phantom) when the injector tip 44 is in its initial position $P_1$ to provide a forward stop for limiting forward travel of the injector tip 44 caused by expansion of the spring 50 under insufficient fuel pressure.

The orifice plate 52*b* helps stabilize the axial translation of the injector tip 44 and restrain undesirable cocking thereof. In the preferred embodiment illustrated in FIG. 2, the injector body 40 further includes an aft facing annular end groove 40*e* sized for axially receiving in part the forward cylindrical end of the injector tip outer shroud 44*a*. In this way, the cylindrical tip shroud 44*a* may slide axially in the groove 40*e* for further controlling axial translation of the injector tip 44.

In view of the sliding components between the injector body 40 and the injector tip 44, a conventional bellows seal 54 is fixedly joined at its opposite distal ends between the injector body 40 and the injector tip 44 radially between the tip shroud 44*a* and the tip hub 44*b* at the forward ends thereof. The bellows seal 54 is an axially corrugated, annular structure which can expand and contract in the axial direction for allowing substantially unrestrained axial movement between the injector tip 44 and the injector body 40. The forward end of the seal 54 is fixedly joined to the injector body 40, and the aft end of the seal 54 is fixedly joined to the injector tip 44. This prevents leakage of the pressurized fuel from the injector body 40 from bypassing the desired fuel flowpath through the center of the injector tip 44. The seal 54 also fixedly joins together the injector body 40 and the injector tip 44 for preventing circumferential rotation therebetween. Antirotation of the injector tip 44 may otherwise be provided by utilizing axial keys in grooves, for example between the orifice disk 52*b* and the injector body 40 if desired.

The air swirler 38 illustrated in FIG. 2 includes a plurality of circumferentially spaced apart swirl vanes 38*a* extending radially outwardly from the tip shroud 44a and fixedly joined thereto in a common casting for example. An annular swirler shroud 38*b* is fixedly joined to the radially outer ends of the swirl vanes 38*a* in a common casting therewith for example. The swirler shroud 38*b* is sized to slidingly engage a conventional annular baffle 56 fixedly mounted to the combustor dome 16*a*.

The swirler outlet 48 is defined between the swirler shroud 38*b* and the tip shroud 44*a* downstream of the swirl vanes 38*a*. The swirler inlet 46 is defined axially between the leading edge of the swirler shroud 38*b* and a corresponding aft-facing portion of the injector body 40 to define an annulus. The axial size of the swirler inlet 46 is variable as the injector tip 44 and swirler 48 attached thereto axially translate under the varying fuel pressure within the injector body. The swirler inlet 46 is illustrated in phantom to the left of the center position for showing the minimum open position thereof when the injector tip 44 is in the initial position $P_1$. The swirler inlet 46 is again shown in phantom line to the right of the center position in its maximum open position when the injector tip 44 is in its fully displaced position $P_2$.

Accordingly, at engine idle, the spring 50 may be sized for maintaining the injector tip 44 in its initial position $P_1$ with a minimum flow area of the swirler inlet 46. At power settings greater than idle, the increase in fuel pressure within the injector body 40 further compresses the spring 52 for translating axially aft the injector body 44 into its fully displaced position $P_2$ so that the swirler inlet 46 has a maximum flow area. This modulation may be suitably tailored for reducing exhaust emissions in the combustion gases during operation. At idle power, the total volume of burned fuel and air mixture may be reduced, with the fuel and air still having a suitable ratio for obtaining effective and more complete burning. The decreased airflow through the swirler 38 at idle effectively increases bulk residence time and combustion temperature within the combustor 16 for ensuring more complete combustion of the fuel and air mixture. At high power, additional air is channeled through the swirler 38 for providing lean combustion to reduce NOx, and the increased flowrate through the swirler 38 effectively decreases the bulk residence time within the combustor 16 for reducing NOx emissions.

The variable area air swirler 38 provides additional ability to modulate the airflow itself being channeled through each carburetor 26 which offers the combustor designer an additional design parameter for obtaining effective performance of the combustor with reduced exhaust emissions at both idle and high power operation. The swirler airflow can thusly be modulated as a function of fuel flow or pressure in a passive arrangement. The variable geometry air swirler allows significantly greater fuel/air modulation than presently available from fuel staging or multi-dome combustors. The improved carburetors 26 may be readily retrofitted to existing combustors without significant change thereto and are scalable to relatively small sizes for use in small combustors. In small engines, suitable exhaust emission reductions may be obtained in a single dome combustor without the need for the more complex double dome combustor typically used in larger engines. The improved carburetors 26 may be used in a multi-dome combustor if desired for obtaining additional performance thereof, with the conventional centerbody between adjacent domes no longer being required because both domes may be fueled at relatively low levels, which is in contrast to conventional operation wherein the pilot dome alone would be fueled without fuel in the main dome, with the centerbody being provided to eliminate quenching between the domes and enhancing combustion stability.

The variable geometry air swirler 38 disclosed above allows air staging, which may be additionally used with conventional fuel staging if desired for obtaining enhanced combustor performance with reduced exhaust emissions. In alternate embodiments, the swirler airflow can increase or decrease with fuel flow. The spool 52 may be alternatively configured for moving upstream instead of downstream under increasing pressure drop. Additional springs may be provided for providing multiple step changes in swirler airflow if desired, or infinitely variable modulation of swirler airflow may be obtained. In the exemplary embodiment illustrated in FIG. 2, airflow metering is accomplished by modulating the area of the swirler inlet 46. In alternate embodiments, modulation of the swirler outlet 48 may be used for preserving air velocity at the swirler outlet 48. The carburetor 26 may further include multiple airflow circuits such as a double swirler design wherein air swirl as well as flowrate may be modulated.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

1. A carburetor for discharging fuel and air into a gas turbine engine combustor comprising:

a fuel injector including a hollow injector body fixedly joined to a hollow supporting stem for receiving fuel therein, and an injector tip slidingly mounted to said injector body for movement relative thereto, said injector tip being disposed in flow communication with said injector body for receiving said fuel and discharging said fuel into said combustor;

an annular air swirler attached to said injector tip for movement therewith, and spaced from said injector body to define an inlet for receiving air, and spaced from said injector tip to define an outlet for discharging swirled air from said swirler concentrically around said fuel discharged from said injector tip; and a spring operatively engaging said injector body and said injector tip for biasing said injector tip and attached swirler to an initial position, and said spring being sized so that increasing pressure of said fuel in said injector body further loads said spring for moving said injector tip and attached swirler from said initial position to a displaced positions.

2. A carburetor according to claim 1 further comprising:

a spool having a spin disk fixedly joined at one end, and an orifice disk fixedly joined to an opposite end, and disposed in said injector body for channeling said fuel axially through said orifice disk and said spin disk, with said spin disk being effective to swirl said fuel; and wherein said spin disk is fixedly joined to said injector tip for swirling said fuel therein; and said spring is disposed between said orifice disk and said injector body so that increasing pressure drop across said spin disk moves said spool and in-turn said injector tip joined thereto.

3. A carburetor according to claim 2 wherein:

said injector body includes an inlet for receiving said fuel from said stem, an outlet slidingly receiving said injector tip, and an aft step adjacent to said body outlet supporting one end of said spring; and said spring includes an opposite end engaging said orifice disk.

4. A carburetor according to claim 3 wherein:

said spring is a compression spring preloaded in compression between said orifice disk and said body aft step for axially translating said spool to said initial position forwardly from said body outlet; and said spin disk includes metering holes sized to meter said fuel into said injector tip and develop a pressure drop thereacross, with increasing pressure of said fuel in said injector body translating said spool axially aft to further compress said spring to axially translate said injector tip to said displaced position.

5. A carburetor according to claim 4 wherein:

said injector body further includes a forward step spaced axially forwardly of said aft step and sized for receiving a perimeter of said orifice disk; and said spool is sized in axial length to initially position said orifice disk away from said forward step, with said forward step providing a stop for limiting aft travel of said orifice disk and injector tip upon compression of said spring.

6. A carburetor according to claim 5 wherein said injector tip includes:

a radially outer shroud;

a radially inner hub radially spaced in part from said tip shroud; and said tip hub includes a cylindrical forward end slidingly engaging said body outlet and fixedly receiving said spin disk therein, and further includes in serial flow communication a spin chamber for receiving said swirled fuel from said spin disk, a venturi, and a spray cone for discharging said swirled fuel into said combustor.

7. A carburetor according to claim 6 wherein said tip hub further includes a forward step around said forward end axially abutting said body outlet in said tip initial position to provide a stop for limiting forward travel of said injector tip.

8. A carburetor according to claim 6 wherein said injector body further includes an aft facing annular end groove sized for axially receiving in part said tip shroud.

9. A carburetor according to claim 8 further comprising a bellows seal fixedly joined between said injector body and said injector tip, and radially between said tip shroud and said tip hub.

10. A carburetor according to claim 6 wherein:

said air swirler includes a plurality of circumferentially spaced apart swirl vanes extending radially outwardly from said tip shroud and fixedly joined thereto, and an annular swirler shroud fixedly joined to radially outer ends of said swirl vanes;

said swirler outlet is defined between said swirler shroud and tip shroud downstream of said swirl vanes; and said swirler inlet is defined axially between said swirler shroud and said injector body, with axial size of said swirler inlet being variable as said injector tip and swirler attached thereto axially translate.

11. A carburetor for discharging fuel and air comprising:

means for injecting said fuel through a moveable injector tip for discharge therefrom, and further including a stationary injector body supporting said injector tip; and means for swirling said air around said fuel discharge from said injector tip, and attached to said injector tip for movement therewith, and including an inlet defined in part with said injector body and having a size variable as said injector tip is moved.

12. A carburetor according to claim 11 wherein said fuel injecting means are responsive to pressure of said fuel to move said injector tip and attached swirling means for modulating airflow through said swirling means for in-turn modulating the ratio of fuel discharged from said injector tip to air swirled through said swirling means.

13. A carburetor according to claim 11 wherein said air swirling means further comprise an outlet defined in part with said injector tip attached thereto.

14. A carburetor according to claim 11 further comprising means responsive to pressure of said fuel for moving said injector tip and varying airflow through said air swirling means.

15. A carburetor for discharging fuel and air comprising:

means for injecting said fuel through a moveable injector tip for discharge therefrom;

means for swirling said air around said fuel discharged from said injector tip, and attached to said injector tip for movement therewith; and means responsive to pressure of said fuel for modulating airflow through an air inlet disposed between said air swirling means and said injector tip.

16. A carburetor for discharging fuel and air into a gas turbine engine combustor comprising:

means for injecting said fuel through an injector tip in a first direction into said combustor;

means for swirling said air around said fuel discharged into said combustor; and means responsive to pressure of said fuel channeled through said injector tip for moving said tip and said swirling means to modulate airflow into said swirling means.

17. A carburetor according to claim 16 wherein said moving means are disposed inside said fuel injecting means.

18. A carburetor according to claim 17 wherein said moving means are configured to move said injector tip in said first direction to increase said airflow into said swirling means.

19. A carburetor according to claim 18 further comprising an annular swirler inlet disposed between said injector tip and said swirling means, and having a flow area adjustable with said tip movement.

* * * * *